United States Patent [19]

Merten et al.

[11] Patent Number: 4,607,890

[45] Date of Patent: Aug. 26, 1986

[54] GUIDES FOR MINERAL MINING MACHINES

[75] Inventors: Gerhard Merten; Bernd Steinkuhl, both of Lunen; Alois Hauschopp, Werne, all of Fed. Rep. of Germany

[73] Assignee: Gewerkschaft Eisenhutte Westfalia, Lunen, Fed. Rep. of Germany

[21] Appl. No.: 642,866

[22] Filed: Aug. 21, 1984

[30] Foreign Application Priority Data

Aug. 27, 1983 [DE] Fed. Rep. of Germany ..... 3330955

[51] Int. Cl.[4] ..... E21C 35/20

[52] U.S. Cl. ..... 299/43; 299/64; 198/735; 198/860.3

[58] Field of Search ..... 299/43, 64; 198/517, 198/735, 860.3

[56] References Cited

U.S. PATENT DOCUMENTS

| | | | |
|---|---|---|---|
| 4,108,495 | 8/1978 | Hauschopp et al. | 299/43 |
| 4,205,882 | 6/1980 | Hauschopp et al. | 299/43 |
| 4,391,471 | 7/1983 | Hauschopp et al. | 299/43 |
| 4,474,411 | 10/1984 | Peters et al. | 299/43 |

FOREIGN PATENT DOCUMENTS

| | | | |
|---|---|---|---|
| 1277783 | 9/1968 | Fed. Rep. of Germany | 299/43 |

*Primary Examiner*—James A. Leppink
*Assistant Examiner*—Matthew Smith
*Attorney, Agent, or Firm*—Sughrue, Mion, Zinn, Macpeak and Seas

[57] ABSTRACT

A mineral mining machine guide is composed of individual sections joined end-to-end alongside the pans of a scraper-chain conveyor. Each guide section has a side wall component and a web plate component with spacers therebetween dividing upper and lower chain guide passages. An inclined foot plate component projects beneath the web plate component which is itself spaced above the foot plate component to form a slot through which the machine engages with the chain run in the lower passage. A pivotable cover closes the upper passage. Toggle-like coupling pieces fit into pockets in the ends of the web plate components of adjacent sections. Compartments in the web plate components above the pockets and at the level of the upper passage receive extensions of the covers which are hinged in these compartments. The coupling pieces are held in place with detachable locking plates which additionally co-operate with the covers to limit their outward pivotal movement.

19 Claims, 7 Drawing Figures

FIG.3
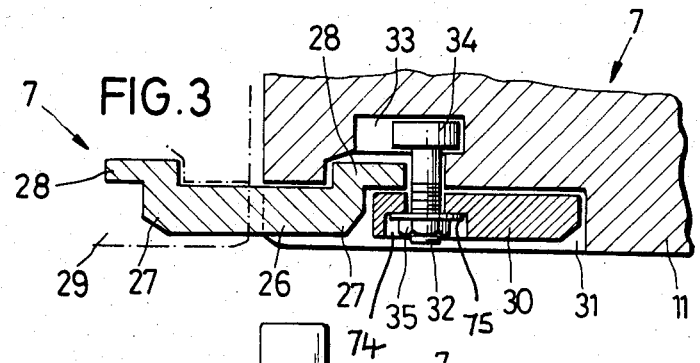
FIG.4
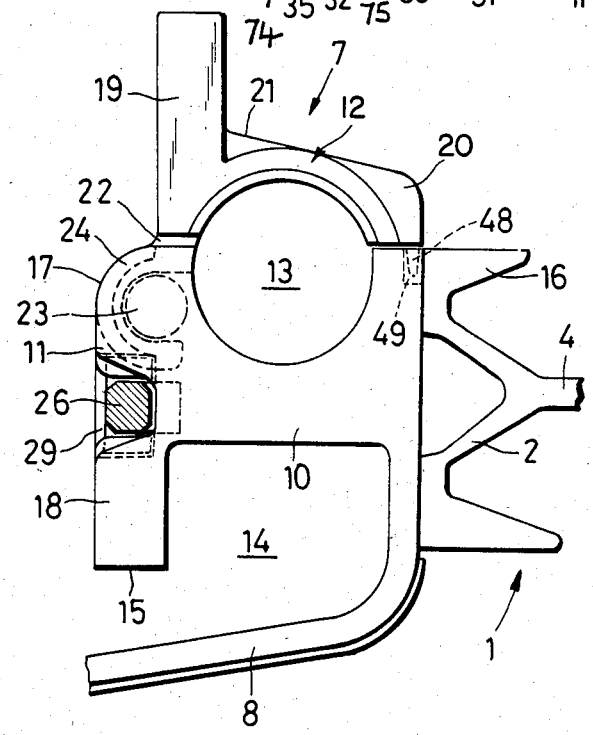
FIG.5
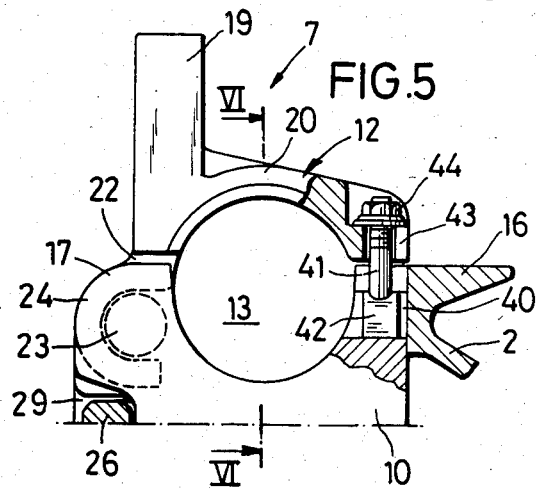
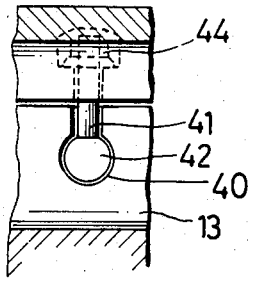
FIG.6

GUIDES FOR MINERAL MINING MACHINES

FIELD OF THE INVENTION

The present invention relates to guides for mineral winning and/or loading machines and particularly, but not solely, to guides for coal ploughs.

BACKGROUND TO THE INVENTION

It is known to attach components to the mineral face side of the conveyor in an underground mine working to form a guide for a 'swordless' plough. The plough is driven back and forth along the guide and the mineral face with the aid of a chain running in upper and lower passages at the mineral face side of the conveyor and protected within the guide. Spacers separate the upper and lower passages and pivotable covers serve to close off the upper passages. These covers are hinged at their lower sides to permit them to be swung outwards to expose the upper passage. U.S. Pat. No. 4,108,495, for example, describes a guide of this known type.

In another known construction described in U.S. Pat. No. 4,391,471 the covers have a flat upper surface adjacent an upstanding rib which forms additional guidance for the machine or plough.

It is also known to construct the guide from sections corresponding to the individual channel sections or pans of the conveyor and to connect the guide sections together with toggle-type couplings which permit some articulation while resisting traction forces.

A general object of the present invention is to provide an improved guide which is particularly stable even over a considerable height yet is easy to erect and assemble.

SUMMARY OF THE INVENTION

The invention is concerned with a guide which is composed of individual sections joined end-to-end with the aid of detachable coupling means, each section comprising means defining upper and lower passages along which a drive chain is circulated during use, said defining means including spacers separating the passages, a generally upstanding web plate component, a cover which serves to close off the upper passage and hinge means for permitting the cover to be pivoted between closed and open positions. In accordance with the invention the web plate component extends upwardly at least substantially to a level corresponding to the centre of the upper passage and compartments are formed in the web plate component in which said hinge means are located, the compartments being located above the coupling means in general alignment with the upper passage. The compartments may take the form of recesses opening from the upper edge of the web plate component and across the width of the latter. Conveniently the upper region of the web plate component is rounded off to form a bead and the recesses extend through this rounded upper region. Pintles or journals can be mounted in the compartments and depending hook-like extensions of the cover may engage on these journals to form the hinges for the cover.

The web plate component is usually a stout strong component providing guidance for a machine or plough and is spaced from an inclined foot plate component as is known to provide a slot through which the machine can make drivable connection with a drive run of the chain in the lower passage. The guide sections would normally be fixed to the channel sections or pans of a scraper-chain conveyor as by welding. Because of the height of the web plate components the covers can be made correspondingly smaller and this results in lighter structures more easily mounted and disassembled and pivoted. The angle through which the covers need to be swung can be quite small; no larger than the distance that the floor plates project beyond the web plate components towards the mineral face. The constructions provided by the invention also permits the passages to be larger in cross-section to enable heavy duty chains to be employed without increasing the size and weight of the covers. The web plate components preferably extend up to at least the level of the upper flange of the side walls of the pans to provide adequate guidance.

The coupling means interconnecting the guide sections can take the form of shaped coupling pieces fitted into pockets again formed by recesses in the web plate components conveniently aligned with the spacers which stiffen the structure. The pockets are conveniently immediately beneath the compartments for the hinge means.

The covers themselves may have upstanding ribs which provide upper guidance for the machine. Conveniently these ribs are offset inwardly towards the conveyor pans relative to the outer plane upstanding surface of the web plate components nearest the mineral face. This again reduces the size and hence the weight of the covers and promotes the efficient loading of a mineral onto the conveyor. The covers advantageously have inclined rear regions merging with the ribs and extending downwardly towards the conveyor pans.

The coupling pieces which are used to interconnect the guide sections are of toggle-like configuaration held in the pockets with detachable locking means or plates. In accordance with further feature of the invention the locking means, which can be detachably secured to the web plate components with bolts or other screw-threaded fixings, additional serves to delimit the pivotal movement of the covers and prevents the detachment of the latter. One possible arrangements has grooves in the extensions of the covers which engage in the compartments which mate with ribs on the locking means. To release the covers it is necessary in this arrangement to first release the locking means. The locking of the coupling pieces can be accomplished by making the locking means overlap tongues on the coupling pieces. Bolts used to secure the locking means or plates may have heads which are held captive inside additional pockets in the web plate components.

The covers are best secured in their closed position with screw-threaded elements. The guide sections may have upstanding side wall components generally parallel to the web plate components and fixed to the side walls of the pans with the spacers extending between the side wall and web plate components. These side wall components or the spacers have recesses which receive projections of the covers and/or the heads of the screw-threaded elements. The heads of the elements can be cylindrical.

Preference is given to an all-welded assembly for the guide sections and normally the pans would have welded-on barrier plates on their sides opposite the mineral face. The avoidance of screw-type connections for the main fabrication is advantageous since such connections are prone to work loose and repair and replacement is time consuming.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein:

FIG. 3 is a sectional plan view of part of the guide, the view being taken along the line III—III of FIG. 2;

FIG. 4 is a sectional view of part of the guide, the view being taken along the line IV—IV of FIG. 2;

FIG. 5 is a part sectional end view of the upper part of the guide shown in FIGS. 1 to 4;

FIG. 6 is a sectional elevation of part of the guide, the view being taken along the lines VI—VI of FIG. 5.

DESCRIPTION OF THE PREFERRED EMBODIMENT

Figure 1:
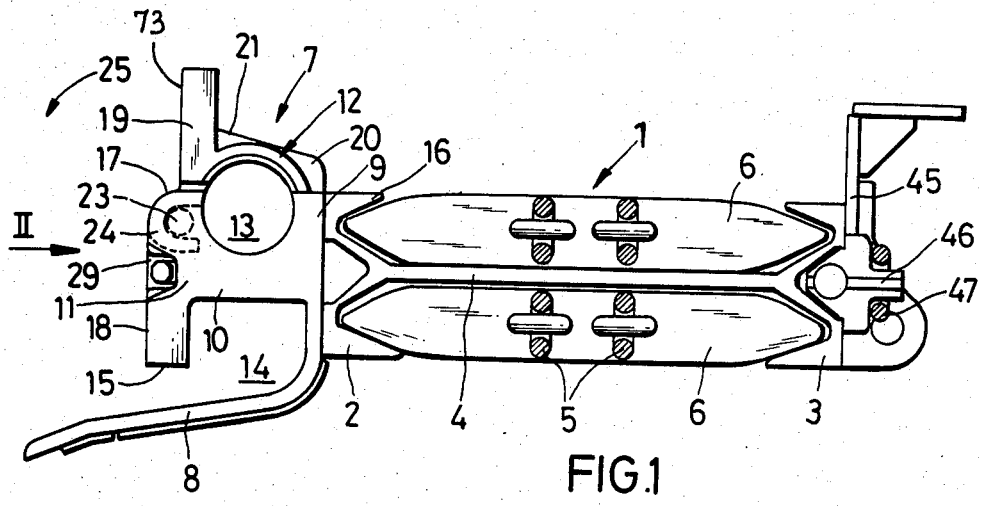
FIG. 1 is a schematic sectional end view of a scraper chain conveyor and guide constructed in accordance with the invention.

As represented in FIG. 1 of the accompanying drawings, a scraper-chain conveyor is constructed in known manner from a series of individual channel sections or pans 1 joined end-to-end. Each pan 1 is composed of generally sigma-shaped side walls 2, 3 with a floor plate 4 welded therebetween to provide upper and lower runs for a scraper-chain assembly 5, 6 circulated along the pans. The scraper-chain assembly 5, 6 as depicted takes the form of a so-called in-board assembly with a pair of chains running along the central region of the pans 1 and scrapers 6 fixed to the chains 5 and spaced apart along the pans 1.

On the goaf side of each pan 1 there is an upstanding barrier plate 45 rigidly affixed to the side wall 3 of the pan. This barrier plate 45 has connectors at the outside for enabling attachments to be secured to the pan 1 as well as traction-resistant couplings at the ends which enable the pans 1 to be interconnected at the goaf sides with some angular mobility. As depicted in FIG. 1, the couplings can take the form of shackles 47 engaged on spigots 46 on the barrier plate 45.

A guide extends alongside the mineral-face side of the scraper-chain conveyor and is likewise built up from separate sections 7 joined end-to-end. The individual pans 1 of the scraper chain conveyor are combined as a constructional assembly with one built-on plough guide section 7. These constructional units can be installed in a working in an assembled stage of built up in-situ if desired. Individual components can be removed and replaced according to need during operation. As is known the guide composed of the sections 7 is adapted for the guidance of a mineral winning machine in the form of a plough without a sword plate which is propelled back and forth along a mineral face (not shown) to strip mineral therefrom. Each guide section 7 has an inclined plate component 8 which rests on the floor of the mine working and adjoins an upstanding plate component 9 fixed to the mineral face side wall 2 of the corresponding conveyor pan 1. Normally the components 9, 8 would be ingtegral with one another as by adopting one-piece L-shaped structures or by welding plates together. Each guide section 7 also has one or more spacers 10 extending outwardly from the wall component 9 at about the level of the plate 4 of the associated pan 1 to separate and partly define upper and lower chain guide passages 13, 14 alongside the component 9. Each guide section 7 further has an outwardly-facing upstanding web plate component 11 and a separate cover 12 which extends over the upper chain passage 13. The components 8, 9, 11 and the cover 12 of each guide section 7 extend over the entire length of the associated pan 1 of the conveyor and normally each section 7 would have two spacers 10, each having a length somewhat less than half the length of the associated pan 1 and spaced apart as is described in U.S. Pat. No. 4,391,471. The spacers 10 are normally connected to the upstanding components 9, 11 but they could be formed integrally with one or both components 8, 9. Where the spacers 10 are separate they may be welded, bolted or screwed onto the upstanding wall component 9.

The web plate component 11 is rigidly connected to the spacers 10 and again this component 11 may be welded or screwed to the spacers 10 or formed integrally with items 10 or 9 or the entire structure 8, 9, 10 as depicted in FIG. 1.

A chain for driving the plough along the guide has a haulage or a drive run (not shown) in th passage 14 and a return run (not shown) in the passage 13 so that the covers 12 close off the return run.

The web plate component 11 of each guide section 7 extends generally parallel to the component 9 thereof and is spaced from the base plate component 8 with its lower edge 15 to thereby provide a gap through which part of the plough extends to make drivable connection with the traction run of the chain in the passage 14.

The web plate component 11 extends upwardly to approximately the same level as the uppermost flange 16 on the mineral-face side wall 2 of the associated conveyor pan 1. The plane of separation or division between the covers 12, the web plate components 11 and the wall plate components 9 is level with the upper flange 16 of the side walls 2 of the pans 1. An upper outwardly-facing region 17 of the web plate component 11 is rounded off to form a bead and the web plate component 11 extends upwardly approximately to the same level as the central longitudinal axis of the passage 13. The web plate component 11 presents an outer surface 18 which is approximately vertical extending from the lower edge 15 to the rounded top region 17.

The cover 12 is approximately L or h shaped in profile and has an upstanding portion or strip forming an upper guide rail 19 for the plough. The rear region 20 of the cover 12 adjacent the pan 1 is shaped to merge smoothly onto the component 9 and the guide strip 19 and has on its inner face a curvilinear profile matching that defined by the component 9, the spacers 10 and the web plate component 11 thus overall to define a circular boundary for the passage 13.

The uppermost surface of the region 20 of the cover 12 is inclined from the guide strip 19 downwardly towards the pan 1. As shown in FIGS. 1, 4 and 5, the strip 19 of the cover 12 is off-set rearwardly from the outer surface 18 of the web plate component 11 and the rounded region 17 forms a smooth transition between the surface 18 an outer upstanding surface 73 of the strip 19.

Figure 2:
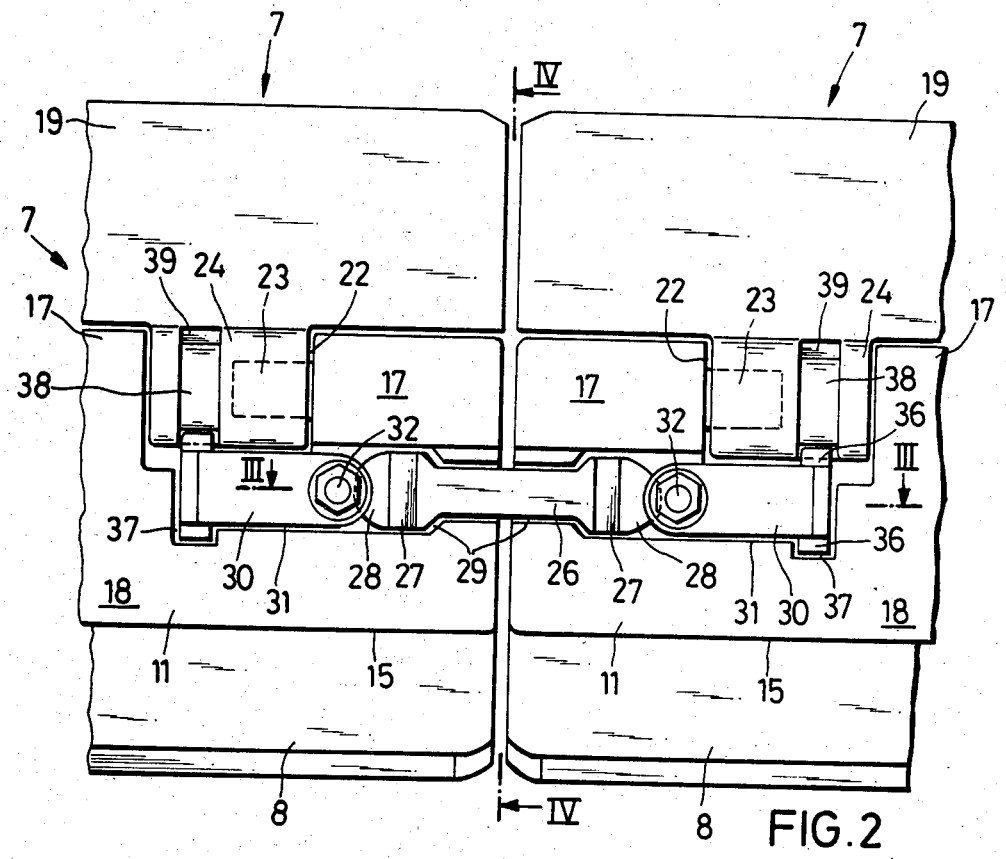
FIG. 2 is an elevation of part of the guide shown in FIG. 1, the view being taken in the direction of arrow II of FIG. 1 and on a somewhat larger scale than that adopted in FIG. 1.

The web plate component 11 of each guide section is formed with a recess 22 in each end approximately level with the upper chain passage 13. Each recess 22 is open across the web plate component 11 and towards the upper end region 17. The recesses 22 form compartments for journals 23 which extend over part of the length of the associated recess 22 as shown in FIG. 2. Each cover 12 is provided at each end with an extension 24 depending from the guide strip 19 which is positioned to engage within the associated recess 22 and around the journal 23 therein in a manner of a hook or claw. The journals 23 and the extensions 24 thus form hinge or pivot joints which enable the covers 12 to be swung outwardly towards the working face in the direction of arrow 25 in FIG. 1 to permit access to the passage 13. Since the spacers 10 of each guide section are spaced apart, by swinging the associated cover 12 outwardly in this manner the lower passage 14 is likewise rendered accessible through the gap between the spacers 10. The extensions 24 are rounded to merge in smoothly with the guide strip 19 and to match the curvature of the upper end region 17 of the web plate component 11.

Figure 7:
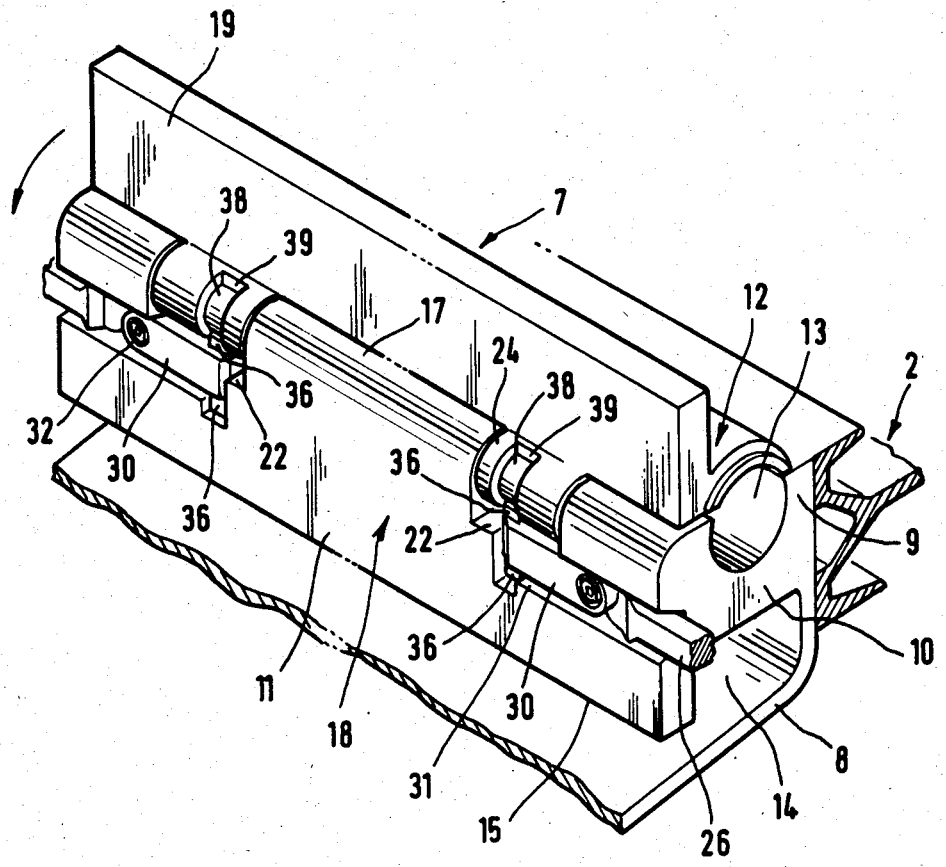
FIG. 7 is a perspective view of part of the guide.

The adjacent guide sections 7 are interconnected in a manner known per se by means of toggle-type couplings. Thus, as shown in FIGS. 2, 3 and 7, a coupling piece 26 has a shank and widened heads 27 at its ends and is additionally provided with axially off-set tongues 28. The web plate components 11 of the adjacent guide sections 7 are provided with shaped recesses 29 at their ends open towards the working face which posess the same shape as the shank and heads 27 of the coupling piece 26 thereby forming pockets for receiving the coupling piece 26. The recesses 29 are located beneath the recesses 22 and are approximately at the same level as the floor plate 4 of the conveyor pan 1, i.e. about half way up the pan 1. The recesses 29 are located in front of the spacers 10 of the guide section 7 relative to the mineral face. FIGS. 2 and 3 show the coupling piece 26 in its pockets or recesses 29 between the two adjacent guide sections 7 and serving to interconnect the guide sections 7 in a manner so as to permit some angular mobility between the guide sections 7 in all directions while resisting traction forces. The toggle connections can replace the connections between the adjacent pans 1 of the scraper-chain conveyor on the mineral face side. The coupling pieces 26 are held in the recesses 29 by locking plates 30 to prevent them from becomming detached from the recesses 29. The locking plates 30 are themselves located in further recesses 31 formed as axial prolongations of the recesses 29 and are positioned beneath the extensions 24 of the covers 12. Each locking plate 30 extends over the tongues 28 of the associated coupling piece and is fixed in position by means of a bolt 32. As can be seen in FIG. 3, at the base of the recess 31 receiving the locking plate 30 there is another pocket 33 in which the head 34 of the securing bolt 32 can be introduced and held captive. The shank of the bolt 32 engages through a bore in the plate 30 which overlaps the tongue 28 and, to fix the plate 30, a nut 35 is engaged on the opposite end of the bolt 32 and tightened up against a washer 75. The nut 35 and washer 75 seat in a shallow recess 74 in the plate 30.

Each locking plate 30 is provided at its ends opposite the bolt connection with upper and lower transverse ribs 36. The lower rib 36 engages in a depression or groove 37 adjacent the end of the associated recess 31 in the web plate component 11, while the upper rib 36 fits in a groove 38 in the associated cover extension 24. By arranging the ribs 36 in the grooves 37, 38 the cover 12 thereabove is subjected to means to limit its opening movement since when the cover 12 is swung in the direction of arrow 25 in FIG. 1 a stop face 39 which delimits the groove 38 in the extension 24 at the upper side makes contact with the upper rib 36 and prevents the cover 12 from pivoting further outwards. In this outwardly-pivoted position, the locking plate 30 also prevents the extension 24 of the cover 12 from being lifted out of the compartment 22. However to dismantle the cover 12, the locking plates 30 at each end of the guide section 7 can be removed by releasing the bolts 32 thus to permit the extensions 24 to be moved out of the compartments 22 in the direction of the working face.

The spacers 10 of each section 7 are provided with shaped recesses 40 adjacent to the side wall 2 as shown in FIGS. 5 and 6. These recesses 40 each receive a securing bolt 41 having a cylindrical lower head 42. The bolts 41 pass through openings 43 in the associated cover 12 and these openings 43 are such that when the cover 12 is swung into the closed position (FIGS. 1 and 5) the bolts 41 locate in the openings 43. Nuts 44 engaged on the upper ends of the bolts 43 are located in depressions in the top surface of the region 20 of the cover 12 and serve to fix the cover 12 in its closed position. As shown in FIG. 4, the cover 12 also has projections 48 depending from its rear region 20 which locate in pockets 49 in the upper edge of the wall component 9 to hold the cover 12 laterally in the closed position. The lower regions of the recesses 40 are made cylindrical (FIG. 6) to match the shape of the heads 42. The bolts 41 are prevented from rotating within the recesses 40 by their heads 42 but a certain freedom of movement is provided to enable the bolts 41 to be manoeuvred into the openings 43 when the cover 12 is being closed. In order to swing a cover on its hinges in the direction shown by arrow 25, it is thus first necessary to release the nuts 44. The covers 12 can then be swung about the journals 23 until they contact the stops 36 which hold the cover 12 in an outwardly pivoted position which is largely determined by the available space provided by the width of the guide section 7 and more particularly by the floor plates 8.

In one practical construction all the parts of the guide sections 7, with the exception of the covers 12 are welded into place. For example, the components 9 can be fitted first, then the spacers 10 and possibly the components 8, if separate from the components 9 and finally the components 11. It is however possible to unite various components as pre-formed fabrications welded together. The barrier plates 45 are likewise welded to the side walls 3 of the pans 1. The use of welded connections avoids difficulties often encountered by screws or bolts working loose.

We claim:

1. In a guide for mineral mining composed of a plurality of individual sections (7) joined end-to-end with the aid of detachable coupling means (26,30), each section comprising means defining upper and lower passages (13, 14) along which a drive chain is circulated during use, said defining means including spacers (10) separating the passages, a generally upstanding fixed web plate component (11) with a planar outer face (18) disposed outwardly of the spacers relative to the passages, a cover (12) which serves to close off the upper passage, and hinge means (23, 24) between the web plate component and the cover for permitting the cover to be pivoted between closed and open positions; the improvements characterized by: the web plate component being extended upwardly to at least a level substantially corresponding to the center of the upper passage, and compartments (22) formed in the web plate component in which said hinge means are located, the compartments and the hinge means being located above the coupling means and in alignment with the upper passage to reduce the size of the cover and the distance outwardly from the web plate component to which the cover pivots to the open position.

2. A guide according to claim 1, wherein each web plate component has an upper region (17) which is rounded to form a bead.

3. A guide according to claim 1, wherein the covers have upstanding ribs (19) which collectively form a guide rail for the machine.

4. A guide according to claim 3, wherein the ribs are offset from the planar outer faces of the web plate components.

5. A guide according to claim 1, wherein the sections are attached to respective mineral-face side walls of the pans of a scraper-chain conveyor.

6. A guide according to claim 5, wherein the web plate components extend substantially to the level of the uppermost surface of the mineral face-side walls of the conveyor pans.

7. A guide according to claim 1, wherein the coupling means takes the form of toggle elements located in shaped pockets of adjacent sections and detachable locking means secures the toggle elements in the pockets.

8. A guide according to claim 7, wherein the detachable locking means provides means (36) to delimit the outward pivotal movement of the associated covers.

9. A guide according to claim 7, wherein the hinge means takes the form of journals in the compartments and extensions of the covers which engage with the journals in hinging manner while permitting the covers to be detached and the detachable locking means also prevent the detachment of the covers.

10. A guide according to claim 7, wherein the detachable locking means comprises plates fixed to the web plate components with screw-threaded elements.

11. A guide according to claim 10, wherein the locking plates overlap tongues of the toggle elements and fit into further recesses in the web plate components.

12. A guide according to claim 10, wherein the screw-threaded elements are bolts with heads accommodated in pockets in the web plate components.

13. A guide according to claim 1, wherein each section further comprises an upstanding side wall component generally parallel to the web plate component (9) and an inclined floor plate component extending beneath the web plate component (8) and delimiting the lower passage from below.

14. A guide section according to claim 1, wherein the spacers have recesses for accommodating screw-threaded fixing elements usable to secure the covers in their closed position.

15. A guide according to claim 14, wherein the fixing elements have cylindrical heads which locate in the recesses.

16. A guide according to claim 13, wherein the side wall components have recesses which receive projections of the covers when the latter adopt the closed position.

17. A guide according to claim 5, wherein the covers have upstanding ribs which collectively form a guide rail for a machine and generally inclined rear regions which extend from the ribs towards the mineral face side walls of the pans.

18. A guide according to claim 5, wherein the sections of the guide are welded to the side walls of the conveyor pans.

19. In a guide for a mineral mining machine; said guide being composed of individual guide sections joined end-to-end with detachable coupling means, the coupling means being composed of toggle elements located in shaped pockets of adjacent sections and detachable locking means which secures the toggle elements in the pockets, each guide section comprising means defining upper and lower passages along which a chain moves to propel the machine along the guide, the defining means including spacers separating the passages, an upstanding web plate component, a cover which serves to close off the upper passage and hinge means for permitting the cover to be pivoted between closed and open positions; the improvements wherein each of the web plate components extends upwardly at least substantially to a level corresponding to the center of the upper passage, the hinge means takes the form of journals in compartments formed in the web plate components and extensions of the covers which engage with the journals in hingeing manner while permitting the covers to be detached, the detachable locking means of the coupling means also cooperates with the hinge means to prevent the covers being detached, the extensions of the covers have grooves which locate with ribs formed on the locking means and provide stop means limiting the pivotal movement of the covers, and the compartments are located above the coupling means in alignment with the upper passage.

* * * * *